United States Patent [19]

Smith

[11] Patent Number: 4,997,231

[45] Date of Patent: Mar. 5, 1991

[54] SUNSHADE FOR AN INFANT CARRIER OR CAR SEAT

[76] Inventor: Roberta W. Smith, 11517 Vimy Rd., Granada Hills, Calif. 91344

[21] Appl. No.: 441,994

[22] Filed: Nov. 28, 1989

[51] Int. Cl.[5] ..... A47C 7/66; A47C 15/00

[52] U.S. Cl. ..... 297/184; 297/183; 297/DIG. 6

[58] Field of Search ..... 297/183, 184, DIG. 6; 135/96, 97; 5/416, 418

[56] References Cited

U.S. PATENT DOCUMENTS

| | | | |
|---|---|---|---|
| 1,569,045 | 1/1926 | Sommer | 297/183 |
| 1,770,841 | 7/1930 | Clyman . | |
| 1,897,525 | 2/1933 | McGill . | |
| 2,015,588 | 9/1935 | Brown | 5/343 |
| 2,344,010 | 3/1944 | Walsh | 2/69 |
| 2,543,597 | 2/1951 | Peery | 135/7.1 |
| 2,689,148 | 9/1954 | McMullin | 296/78 |
| 2,790,452 | 4/1957 | Dasek | 135/96 X |
| 2,932,833 | 4/1960 | Wambach | 5/337 |
| 3,241,160 | 3/1966 | Escobar | 297/184 X |
| 4,027,687 | 6/1977 | McGowan | 297/DIG. 6 X |
| 4,733,906 | 3/1988 | Davis et al. | 297/184 |
| 4,761,032 | 8/1988 | Sanchez | 297/DIG. 6 X |

FOREIGN PATENT DOCUMENTS

| | | | |
|---|---|---|---|
| 8201984 | 6/1982 | World Int. Prop. O. | 297/184 |

OTHER PUBLICATIONS

The Right Start Catalog; Spring/Summer 1988, back cover; Shade-A-Babe.

*Primary Examiner*—Peter R. Brown

*Attorney, Agent, or Firm*—Lyon & Lyon

[57] ABSTRACT

A sunshade for an infant carrier or car seat including (1) a top cloth portion which extends from the carrier handle to the head of the carrier and (2) a mesh portion on either side of the top cloth portion extending from the carrier handle to the carrier head, the top cloth portion including a gap at the top center of the handle to facilitate grasping thereof.

12 Claims, 1 Drawing Sheet

SUNSHADE FOR AN INFANT CARRIER OR CAR SEAT

BACKGROUND OF THE INVENTION

The present invention relates to accessories for infant carriers and car seats. Due to the mobility of society, infants are frequently transported, often by automobile, and by law many jurisdictions, the child must be placed in a car seat. Either in or out of the car, the child is subjected to the elements. The infant is frequently placed in a hot car or outside and is subject to direct sunlight. The infant, frequently not being sufficiently mobile to seek shade on its own, must depend on others to take appropriate steps to provide shade.

Towels may be placed over the carrier or the carrier may be strategically positioned under an umbrella or in another shaded spot to provide the needed protection from the direct sunlight. Many child care products have recognized the need for shade devices. Baby strollers and other baby equipment have half domed shade devices which are typically opaque and nonadjustable.

There is an existing shade device for an infant car seat or carrier consisting primarily of a fabric shade with an elastic hem which is placeable over the infant carrier. The cover inhibits access to the carrier handle and with only a small mesh cut-out in the center of the cover, it provides very little visibility of the infant or air ventilation.

SUMMARY OF THE INVENTION

The present invention is a sunshade or cover for the infant carrier or car seat. The typical infant car seat has a rounded basket with a head portion and a foot portion and a U-shaped handle attached on either side of the basket. The sun shade includes of a top cloth portion which extends from the head portion of the car seat over the handle. Attached on either side of the top cloth portion is a mesh portion which also extends from the head portion to a side of the handle, the lower part of the mesh portion extending underneath the basket. The top cloth portion includes a gap at the center of the top of the handle to provide gripping access for the person carrying the car seat.

DETAILED DESCRIPTION OF THE PREFERRED EMBODIMENT

The preferred embodiment will now be described with reference to the figures. To assist in the description, any numeral an element in one figure will represent the same element in any other figure.

Figure 1:
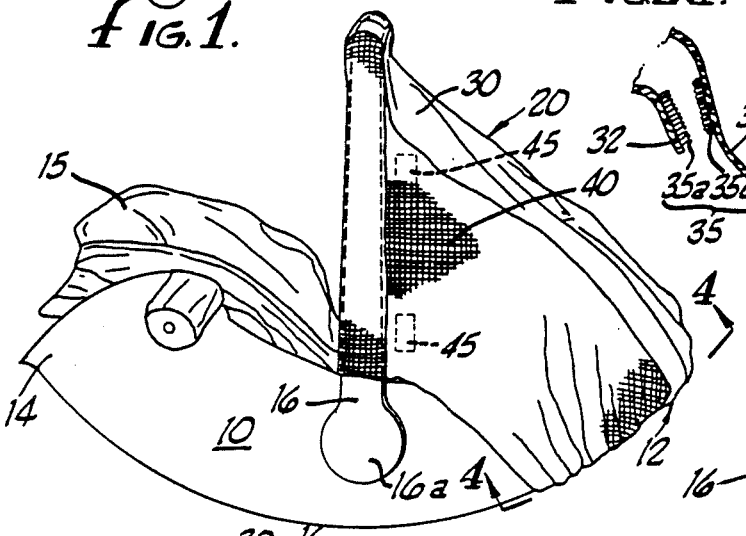
FIG. 1 is a side plan view of a sunshade according to the present invention installed on a typical infant car seat.

FIG. 1 is a side plan view of a sunshade 10 according to the present invention installed on a typical infant car seat 10. The car seat 10 is basically a basket with a turtle shell-like shape with cushions 15 along its interior on which the infant may recline. The infant car seat 10, being somewhat oblong in shape, has sides, a head or top portion 12 and a foot or bottom portion 14 which form a seating area for an infant being placed therein. A U-shaped handle 16 is attached at about the center of each side of the infant car seat 10 and extends upward therefrom thereby serving as a carrying handle. The handle 16 may pivot about a pivot point 16*a* at the attachment to the side of the car seat 10. The sunshade 20 of the present invention is comprised of a top cloth portion 30 which extends from the head portion 12 to the top of the handle 16 and two side mesh portions 40 each of which extends from the head portion 12 to a side of the car seat handle 16.

Figure 2:
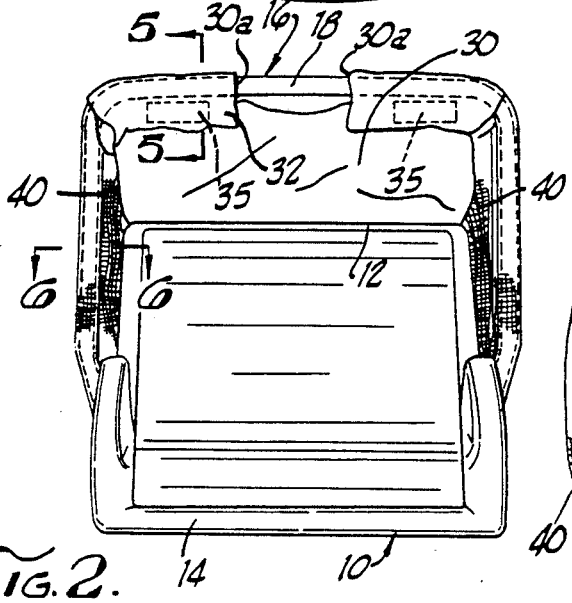
FIG. 2 is a front plan view of the sunshade installed on an infant car seat.
Figure 3:
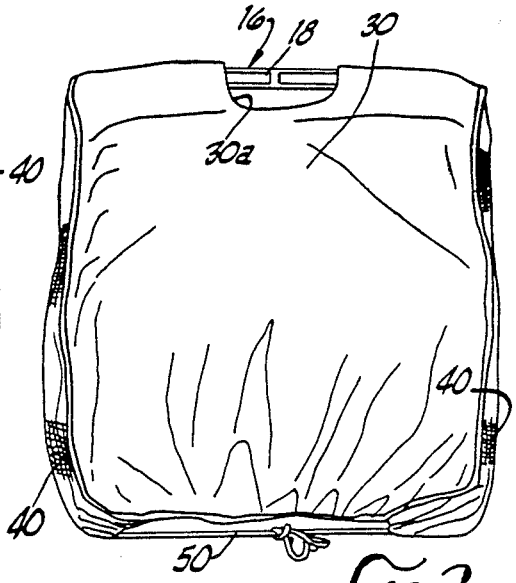
FIG. 3 is a rear plan view of the sun shade installed on an infant car seat showing the lower tying means.
Figure 4:
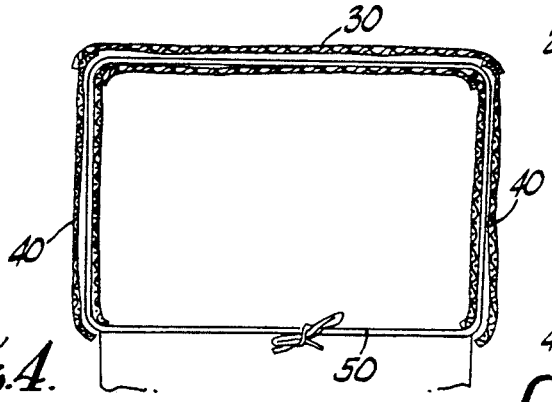
FIG. 4 schematically illustrates the tying means of the sunshade as in FIG. 3.

As viewed in FIGS. 2, 3 and 4 both the mesh side portions 40, 40 and the top cloth portion 30 of the sunshade 10 are secured around the head portion 12 of the infant car seat 10 by a cord 50 which runs through a channel formed in the bottom edges of the side mesh portions 40, 40 and the top cloth portion 30. The cord 50 may be drawn tight and tied to secure the sunshade 20 to the head portion 12 of the car seat 10.

The cord 50 is preferably made from an elastic material to permit adjustment of the shade 20 about the head portion 12 of the car seat 10. Alternately, the cord 50 may be replaced by an elastic hem extending up along the sides of the side mesh portions 40, 40 toward the handle 16.

Both the side mesh portions 40, 40 and the top cloth portion 30 are attachable to the handle 16 by an appropriate attaching means. The preferred attaching means is a plurality of fabric strips 35, 45 of hook and loop fastening material known under the trademark VELCRO®, but other suitable attaching means may include snaps or ties. Preferably the attaching means allows detachability so that the entire sunshade 20 may be removed for cleaning. Though fabric strips of hook and loop fastening material is often provided with a self-adhesive backing for attachment, the strips 35 and 45 are preferably sewn into place thereby not relying on adhesive properties.

Figure 5A:
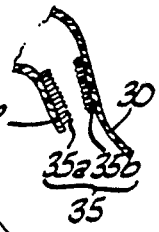
FIG. 5*a* is a detail of FIG. 5 illustrating the attachment means in a separated condition.
Figure 5:
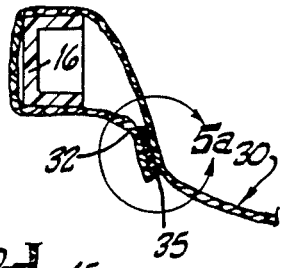
FIG. 5 is a cross-sectional view of the attachment means for the top cloth portion of the sunshade of FIG. 2 taken along the line of 5—5.
Figure 6:
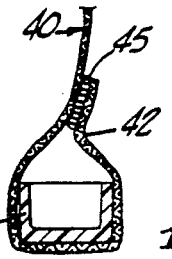
FIG. 6 is a cross-sectional view of the attachment means for the side mesh portion of FIG. 2 taken along the line of 6—6.

As best viewed in FIGS. 2, 5 and 6, the top cloth portion 30 wraps around the handle 16. As also viewed in FIG. 5*a*, the edge 32 of the top cloth portion 30 has a strip 35*a* of hook type fastening of material which may be matingly connected to a corresponding strip 35*b* of loop type fastening material which is secured to the body of the top cloth portion 30. Similarly, the side mesh portions 40 have fabric strips 45 of hook type fastening material which matingly connect the ends 42 to corresponding strips of loop type fastening material on the body of the side mesh portions 40. Of course, the specific positions of the hook and loop fastening materials may be reversed.

By detaching some of the strips 45 from one side of the handle 16, the side mesh portion may be moved away from the handle 16 and folded over the top portion 30 allowing complete side access into the inside of the carrier 10.

The top cloth portion 30 is preferably constructed from a lightweight fabric such as a cotton material which not only can breathe but also blocks the direct sunlight to provide substantial shade underneath. The fabric can be any color may be preferably be of a light color which is more conducive to reflecting rather than absorbing radiant energy.

The side mesh portions 40, 40 allow air to flow freely allowing both hot air to escape out from under the shade 20 and also to allow cool air to pass through into the shade areas. The mesh material also allows light to pass therethrough permitting the infant to see out and the parent to conveniently observe the infant. The infant is protected from sunlight without being isolated or hidden from view.

The top cloth portion 30 has a gap **30*a* along the handle 16 at the top center portion 18 thereof. The gap 30*a* allows the top portion 18 of the handle 16 to be conveniently grasped even while the shade 20 is secured on the car seat 10**. The previous shade design fully covered the handle preventing convenient grasping and also causing potential slippage as loose fabric slides against the handle.

The handle 16 may be pivoted forward providing further coverage over the infant within the car seat 10. Sunshade material which is positioned underneath the head portion 12 of the car seat 10 may slide over the head portion 12 and allow the handle 16 to pivot counterclockwise as viewed in FIG. 1 thereby providing additional shade coverage for the infant inside.

Figure 7:
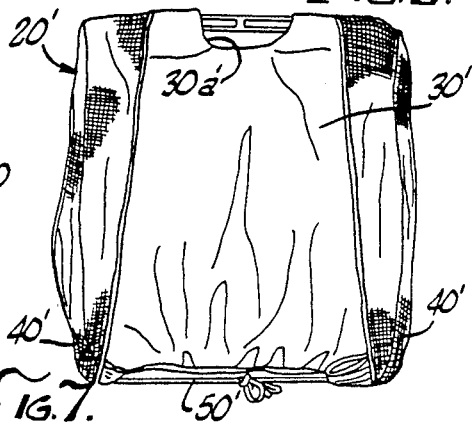
FIG. 7 is a plan view of an alternative sunshade having extended mesh portions.

FIG. 7 illustrates an alternative sunshade 20' having side mesh portions 40' which extend inwardly toward the center 18 of the handle 16. The top cloth portion 30' has a reduced area and the enlarged side mesh portions 40' provide additional ventilation area. The remaining features of the alternative sunshade 20' are similar to sunshade 20 of FIG. 3. The top cloth portion 30' has a gap **30*a*' to allow access to the center 18 of the handle 16. The top cloth portion 30' and the side mesh portions 40' are tied down by the cord 50. Alternately, the side mesh portions 40' may extend all the way to the gap 30*a*'** to provide even more ventilation.

Thus, a sunshade for an infant carrier or car seat has been disclosed. While embodiments and applications of this invention have been shown and described, it would be apparent to those skilled in the art that many more uses and modifications are possible without department from the inventive concepts herein. The invention, therefore, is not to be restricted except in the spirit of the claims that follow.

What is claimed is:

1. In a child carrier or car seat having (1) a body with sides, a head portion, and a foot portion forming a seating area and (2) a U-shaped handle attached to each side, the improvement comprising a cover therefore, including:

a cloth top portion detachably connectable to the handle and extendable from a top of the handle to the head portion, the top portion having a gap at its center at a top of the handle providing access to the handle for carrying and two mesh portions, one connected to each side of the top portion and extendable along the respective side of the carrier, each mesh portions being detachably connectable to a respective side of the handle.

2. The cover according to claim 1 wherein the top portion and the mesh portions wrap around the handle and attach to themselves.

3. The cover according to claim 2 wherein the top portion and the mesh portions detachably attach to themselves by means of mating fabric strips of hook and loop fastening material secured therealong.

4. The cover according to claim 3 wherein (1) first strips of hook material or loop material are secured (a) along an edge of the top portion on one side thereof and (b) along edges of the mesh portions and (2) mating second strips of the other material are secured (a) on the top portion inwardly from the edge and parallel thereto on the other side thereof and (b) on the mesh portions inwardly from the edges and parallel thereto on the other side thereof.

5. The cover according to claim 1 wherein the top portion and mesh portions are secured to the head of the carrier by a cord positioned within a channel formed within outer edges of the top portion and mesh portions.

6. The cover according to claim 1 wherein the top and mesh portions are secured to the carrier by an elastic hem along outer edges of the top and mesh portions.

7. A child carrier or car seat comprising:

a body including sides, a head portion, a foot portion, and a U-shape handle connected to each side; and a cover comprising:

a cloth top portion detachably connectable to the handle and extending from a top of the handle to the head portion, the top portion having a gap at its center at a top of the handle providing access to the handle for carrying and two mesh portions, one connected to each side of the top portion and extending along the respective side of the carrier, each mesh portions being detachably connectable to a respective side of the handle.

8. A device according to claim 7 wherein the top portion and the mesh portions wrap around the handle and attach to themselves.

9. A device according to claim 8 wherein the top portion and the mesh portions detachably attach to themselves by means of mating fabric strips of hook and loop fastening material secured therealong.

10. The cover according to claim 8 wherein (1) first strips of hook material or loop material are secured (a) along an edge of the top portion on one side thereof and (b) along edges of the mesh portions and (2) mating second strips of the other material are secured (a) on the top portion inwardly from the edge and parallel thereto on the other side thereof and (b) on the mesh portions inwardly from the edges and parallel thereto on the other side thereof.

11. The device according to claim 7 wherein the top portion and mesh portions are secured to the head of the carrier by a cord positioned within a channel formed within outer edges of the top portion and mesh portions.

12. The device according to claim 7 wherein the top and mesh portions are secured to the body of the carrier by an elastic hem along outer edges of the top and mesh portions.

* * * * *